US006132123A

United States Patent [19]

Gueret

[11] Patent Number: 6,132,123

[45] Date of Patent: Oct. 17, 2000

[54] RECEPTACLE INCLUDING AN ANTI-SPILL PIECE, AND AN ANTI-SPILL PIECE

[75] Inventor: Jean-Louis Gueret, Paris, France

[73] Assignee: L'Oreal, Paris, France

[21] Appl. No.: 09/205,284

[22] Filed: Dec. 4, 1998

[30] Foreign Application Priority Data

Dec. 19, 1997 [FR] France ..... 97 16161

[51] Int. Cl.[7] ..... A46B 11/00

[52] U.S. Cl. ..... 401/129; 401/131; 401/48; 401/14

[58] Field of Search ..... 401/126, 131, 401/14, 48, 124, 129, 88

[56] References Cited

U.S. PATENT DOCUMENTS

| | | | |
|---|---|---|---|
| 2,140,231 | 12/1938 | Jefferis . | |
| 2,533,349 | 12/1950 | Burger | 401/131 |
| 3,146,806 | 9/1964 | Ginsburg . | |
| 3,809,226 | 5/1974 | Ferrari | 401/129 |
| 4,799,636 | 1/1989 | Johnson . | |
| 4,941,579 | 7/1990 | Lee . | |
| 5,391,011 | 2/1995 | Gueret . | |
| 5,513,885 | 5/1996 | Joffe . | |

FOREIGN PATENT DOCUMENTS

| | | |
|---|---|---|
| 0 439 034 A1 | 7/1991 | European Pat. Off. . |
| 924.786 | 8/1947 | France . |
| 1.214.726 | 4/1960 | France . |

*Primary Examiner*—David J. Walczak
*Attorney, Agent, or Firm*—Oliff & Berridge, PLC

[57] ABSTRACT

A receptacle comprising an applicator and a body forming a reservoir suitable for containing a fluid substance, said body being provided with a top opening. The receptacle includes at least one anti-spill piece fitted to the outside of said body, said piece being suitable for holding the opening of the body of the receptacle above the level of the liquid in the body of the receptacle when the receptacle is resting on a plane surface.

20 Claims, 5 Drawing Sheets

RECEPTACLE INCLUDING AN ANTI-SPILL PIECE, AND AN ANTI-SPILL PIECE

The present invention relates to receptacles provided with a top opening and more particularly, but not exclusively, receptacles having an applicator comprising a stalk provided at one end with a handle member that also constitutes a closure cap, and having at its other end an applicator element.

BACKGROUND OF THE INVENTION

Such receptacles are used for packaging liquids such as nail polish, for example.

U.S. Pat. No. 3,146,806 proposes inserting a shutter in the neck of a receptacle, the shutter being constituted by a disk that is split radially so as to form flexible sectors that close the opening of the receptacle when the applicator is withdrawn, said closure being for the purpose of preventing the liquid contained in the receptacle spilling out in the event of accidental overturning.

Nevertheless, it is not possible to envisage using such a shutter when it is desirable to avoid wiping the applicator element, or indeed when it is desirable to wipe the applicator element, but to do so in a special manner that cannot be obtained if the applicator element needs to pass through the above-specified shutter.

OBJECTS AND SUMMARY OF THE INVENTION

An object of the invention is to prevent substance from spilling out of the receptacle in the event of it being overturned accidentally, but without thereby influencing the way in which the substance is taken by the applicator.

According to the invention, this is achieved by a novel receptacle of the type comprising an applicator and a reservoir-forming body, suitable for containing a fluid substance and provided with a top opening, the receptacle including at least one anti-spill piece applied to the outside of said body, said piece being suitable for holding the opening of the receptacle body above the level of liquid in the receptacle body when the receptacle is resting on a plane surface.

In a particular embodiment, the anti-spill piece has at least one convex outside face and an inside face shaped to fit closely over relief on a face of the receptacle body.

In a particular embodiment, the anti-spill piece is horseshoe-shaped and has a hole passing through the top thereof for receiving the neck of the receptacle.

In another particular embodiment, the anti-spill piece is in the form of a ring and is shaped to be engaged around the receptacle.

In a particular embodiment, the anti-spill piece has, in axial section, a profile selected so that it can roll on said plane surface and so that the reaction force on said surface is positioned relative to a vertical plane passing through the center of gravity of the receptacle on the same side as the opening of the receptacle so as to establish a couple tending to return the receptacle towards an equilibrium position in which the opening is situated above the level of the liquid.

In a particular embodiment, the anti-spill piece completely surrounds the side wall of the receptacle body, except in the vicinity of said opening.

Still in a particular embodiment, the anti-spill piece comprises two portions to be assembled around the body of the receptacle.

These two portions can be interconnected by a hinge adjacent to the bottom wall of the receptacle body.

Once the two portions have been assembled together, the anti-spill piece can form a cage around the receptacle body, protecting it from shock while preventing the substance contained inside it from spilling out in the event of it being accidentally overturned or when the receptacle is lying on a plane surface.

Advantageously, the anti-spill piece is fixed to the receptacle body so that it cannot rotate thereon, thus avoiding any difficulty with screwing or unscrewing the applicator when the receptacle has a threaded neck.

The receptacle fitted with the anti-spill piece of the invention may contain nail polish or some other cosmetic, and has a capacity that is small, being less than or equal to 100 ml, and preferably less than or equal to 25 ml, and even more preferably less than or equal to 10 ml.

The invention also provides a receptacle containing nail polish, the receptacle comprising a body forming a reservoir of small capacity, said body being provided with a top opening surrounded by a threaded neck, the receptacle further including an applicator provided at one end with a closure cap for screwing onto said neck and at its other end with an applicator element, said receptacle including at least one anti-spill piece fitted to the outside of said body, said piece being suitable for holding the opening of the body of the receptacle above the level of the liquid in the body of the receptacle when the receptacle is resting on a plane surface, said piece also being fixed on the body of the receptacle so that it cannot rotate relative thereto and allowing the body of the receptacle to be seen, at least in part, which body is made of a transparent material so as to enable the user to observe the level of liquid in the receptacle.

The invention also provides an anti-spill piece constituting an accessory sold independently of a bottle, the anti-spill piece being designed to be fixed to the bottle which includes an applicator, the anti-spill piece being put into place on the bottle so as to prevent substance from spilling out when the bottle lies on a plane surface at least via its bottom and via said anti-spill piece, particularly in the event of the bottle being overturned accidentally, said anti-spill piece including means enabling it to be fixed onto the bottle by the user.

The user can easily fit an existing bottle with one or more anti-spill pieces of the invention.

The manufacture and sale of an anti-spill piece of the invention, independently of the bottle to which it is to be fitted, presents numerous advantages, and in particular:

the anti-spill piece does not alter the appearance of the bottle while it is being presented for sale;

any information carried by the bottle is not hidden; and the bottle can be made without increasing its cost, thereby making the use of such an anti-spill piece economically advantageous.

The anti-spill piece is advantageously made of a material and/or of a shape that is suitable for absorbing shocks and thereby protecting the bottle.

The anti-spill piece can be made, in particular, out of an elastomer or out of a cellular material optionally shaped by being compressed.

The invention also provides a support for a receptacle as specified above, the support including a support wall through which there passes an opening in which the body of the receptacle is inserted, the dimensions of the opening being selected in such a manner that the anti-spill piece rests on said support wall.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
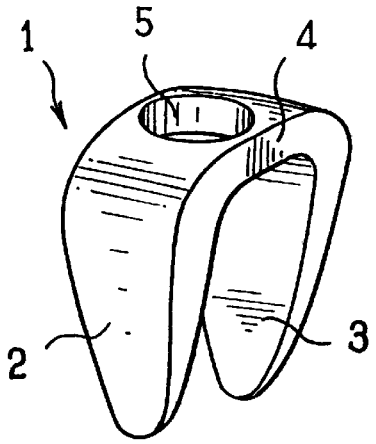
FIGS. 1 to 3 show a receptacle fitted with an anti-spill piece constituting a first embodiment of the invention.

FIG. 1 shows an anti-spill piece 1 constituting a first embodiment of the invention.

Figure 2:
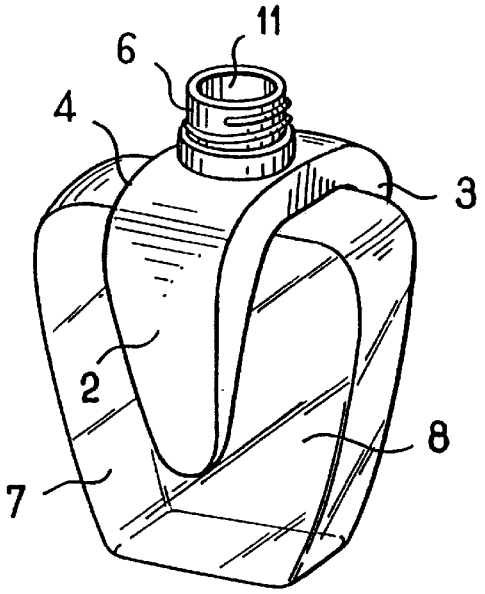

The piece 1 is horseshoe-shaped, having two side portions 2, 3 united by a top portion 4 through which there passes a hole 5 for receiving the neck 6 of a bottle 7, as shown in FIG. 2.

The bottle 7 is of a generally flat shape and it is made of plastics material or glass.

The bottle 7 preferably contains a viscous substance that does not splash in the event of the bottle being accidentally overturned.

The facing faces of the side portions 2 and 3 are shaped to fit closely over relief on the opposite main faces 8 and 9 of the bottle 7.

The anti-spill piece 1 can be fixed on the bottle 7 by adhesive for example, or in a variant the anti-spill piece 1 can be held merely by friction.

The neck 6 is threaded so as to receive a screw cap for closure purposes (not shown), which cap also serves as a handle for an applicator such as a brush, for example, which applicator is received inside the bottle 7 when it is closed.

The bottle 7 has a flat bottom 10 which enables it to stand upright with its axis vertical, when placed on a plane surface S.

Should the bottle 7 be overturned accidentally, the anti-spill piece 1 makes it possible to prevent the liquid contained inside the bottle from spilling out through the opening 11 in the neck 6.

To this end, the side portions 2 and 3 of the anti-spill piece 1 are shaped so as to bear against the plane surface S and hold the axis of the bottle 7 sloping upwards sufficiently to ensure that the level of liquid inside the bottle 7 remains below the edge of the opening 11, even when the bottle is full.

The shape of the anti-spill piece 1 can easily be determined by the person skilled in the art as a function of the shape of the bottle 7, and as a function of the quantity of liquid that is normally contained therein.

The anti-spill piece 1 can be made of any suitable material.

In particular, it can be made of a material that is elastically deformable and/or of a cellular material.

When a cellular material is used, it may be compressed in places to impart the desired shape to the anti-spill piece.

The anti-spill piece is advantageously made of a material and in a shape that enables it to absorb shocks and prevent the bottle 7 breaking if it is dropped, particularly when the bottle is made of glass.

The anti-spill piece 1 can also be made of a material that is selected for the appearance it gives to the bottle 7.

The anti-spill piece 1 is preferably offered to the user as an accessory that is independent of the bottle 7, leaving it up to the user to mount the anti-spill piece on the bottle 7 so as to constitute a receptacle of the invention.

In a variant, the bottle 7 can be offered to the user with an anti-spill piece 1 already in place.

Figure 3:
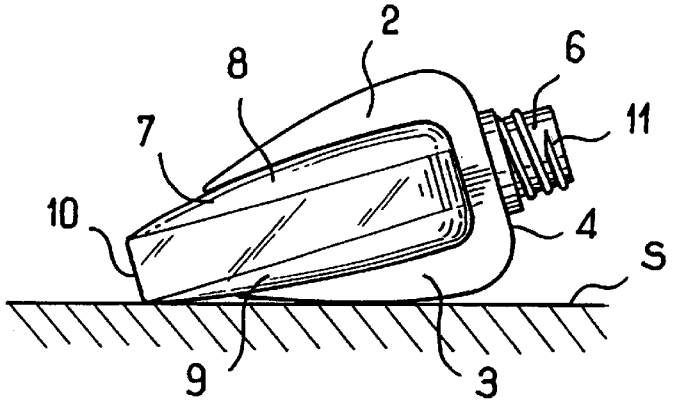

In the example of FIGS. 1 to 3, the bottle 7 is of a flat shape and it is most unlikely that it will end up on its narrow side in the event of being accidentally overturned. There is therefore no need for the anti-spill piece 1 to cover the narrow sides of the bottle 7.

The anti-spill piece 1 can make it easier to take hold of the bottle 7, e.g. between two fingers of the user, by preventing the bottle from slipping between the user's fingers.

In particular, the anti-spill piece 1 does not impede screwing and unscrewing the applicator.

Figure 4:
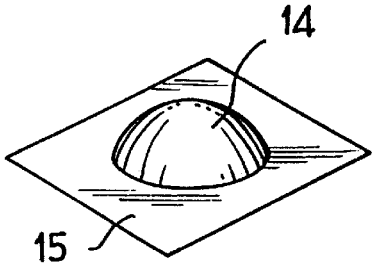
FIG. 4 shows an anti-spill piece constituting a second embodiment of the invention.
Figure 5:
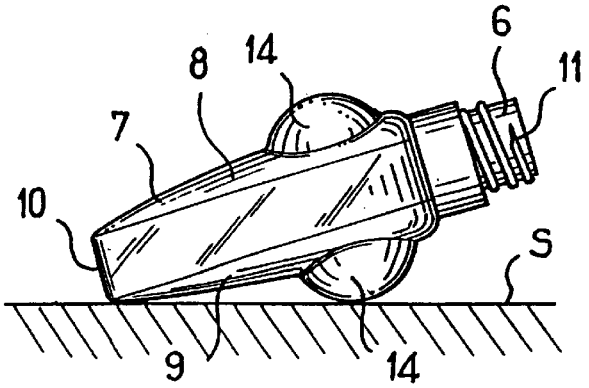
FIG. 5 shows a bottle fitted on each face with such an anti-spill piece.

FIG. 4 shows an anti-spill piece 14 having an outside face that is substantially hemispherical and an inside face that is substantially plane, which face is provided with an adhesive film that is protected prior to being put in place on the bottle 7 by a removable protective sheet 15.

The number of anti-spill pieces 14 and the locations where they need to be fixed depend on the shape of the bottle.

In the example described herein, the user puts two anti-spill pieces 14 on respective faces 8 and 9 of the bottle 7, close to the neck 6, so as to obtain the same result as in the preceding embodiment, i.e. the edge of the opening 11 is held above the level of the liquid when the receptacle is accidentally overturned on the plane surface S.

Figure 6:
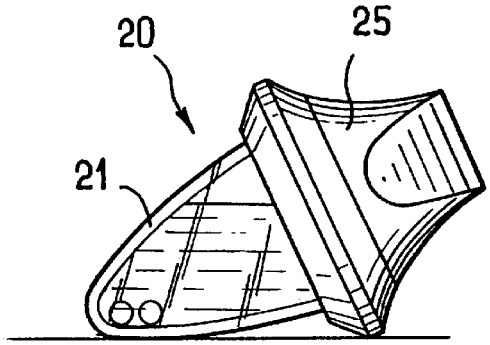
FIGS. 6 to 8 show a third embodiment of the invention.
Figure 7:
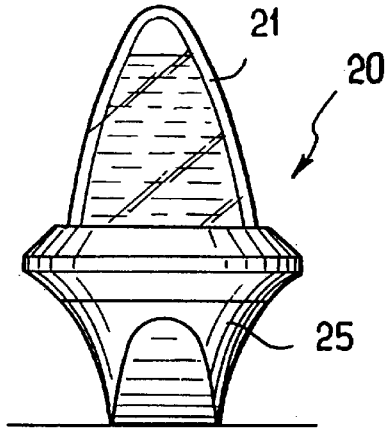
Figure 8:
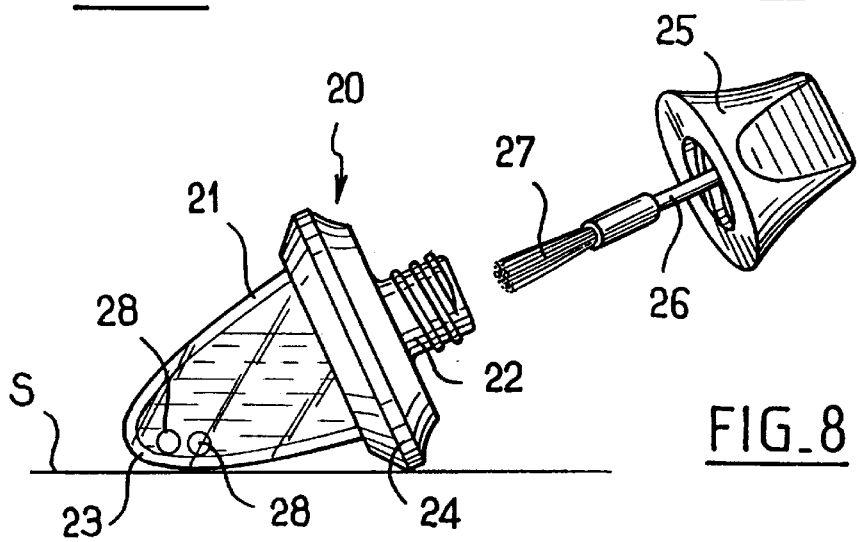

FIGS. 6 to 8 show a receptacle 20 constituting a third embodiment of the invention.

This receptacle 20 comprises a body 21 fitted at one end with a threaded neck 22 and at its other end with an outwardly convex bottom 23.

An anti-spill piece 24 is fitted to the body 21 at the base of the neck 22.

The anti-spill piece 24 is, for example, stuck to the body 21 of the receptacle.

A closure cap 25 is screwed onto the neck 22 to close it.

The closure cap 25 also serves as a handle for an applicator comprising a stalk 26 fixed at one end to the cap 25 and provided at its other end with an applicator member such as a brush 27.

The body 21 may contain one or more beads 28 enabling the substance to be homogenized prior to application, e.g. on the fingernails.

The anti-spill piece 24 is in the form of a ring that projects radially outwards and whose surface is generally convex.

The bottom 23 prevents the receptacle 20 from standing upright.

When the receptacle 20 is placed on a plane surface S, it rests with its axis pointing upwards because of the anti-spill piece 24. The axis of the receptacle 24 then slopes upwards sufficiently to ensure that the level of the liquid contained inside the body 21 does not reach the edge of the opening in the neck 22.

The cap 25 has a truncated top, thereby enabling the receptacle 20 to stand upright when upside-down, as shown in FIG. 7.

Figure 9:
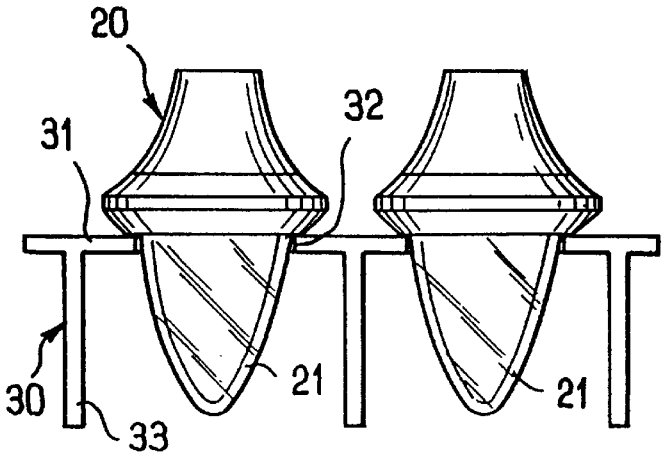
FIGS. 9 and 10 show two display stands for receiving the receptacle of FIGS. 6 to 8.

The receptacle 20 is advantageously put on sale in a display stand 30 comprising a support wall 31 fitted with openings 32 each enabling the body 21 of a receptacle 20 to be received therein, as shown in FIG. 9.

The support wall 31 stands on legs 33 that are longer than the height of the body 21.

The diameter of each opening 32 is smaller than the outside diameter of the anti-spill piece 24 so that the receptacle 20 rests via the anti-spill piece on the support wall 31.

Figure 10:
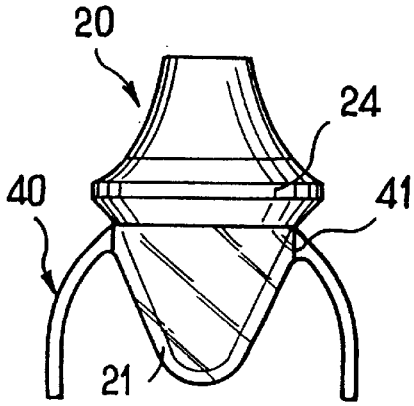

It is also possible to use a display stand 40 that can contain only one receptacle 20, comprising a substantially hemispherical shell 40 having a top opening 41 into which the body 21 of the receptacle 20 can be inserted, as shown in FIG. 10.

The anti-spill piece 24 on the receptacle 20 bears against the display stand 40.

Figure 11:
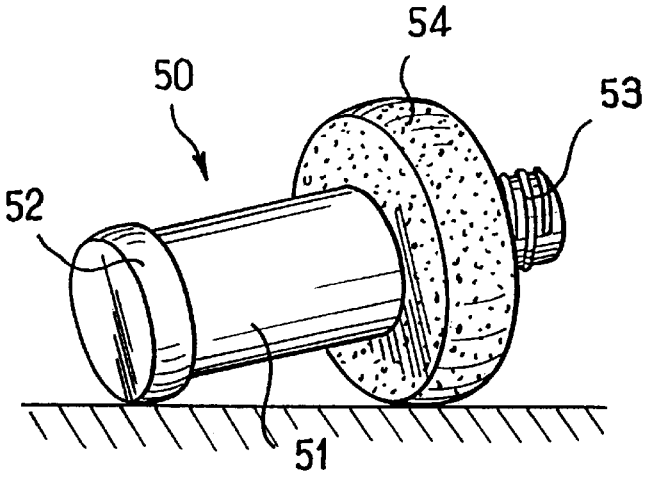
FIG. 11 shows a fourth embodiment of the invention.

FIG. 11 shows a receptacle constituting a new embodiment of the invention.

This receptacle comprises a generally circularly cylindrical bottle 51 provided with a flat bottom which is surrounded by an annular rim 52, and provided at its opposite end with a threaded neck 53.

The anti-spill piece 54 is in the form of a ring fitted onto the cylindrical body of the bottle 51, and positioned close to the neck 53, so as to keep the level of the liquid below the edge of the opening in the neck 53.

In the example of FIG. 11, the anti-spill piece 54 is fixed to the body of the bottle 51, for example by adhesive.

Figure 12:
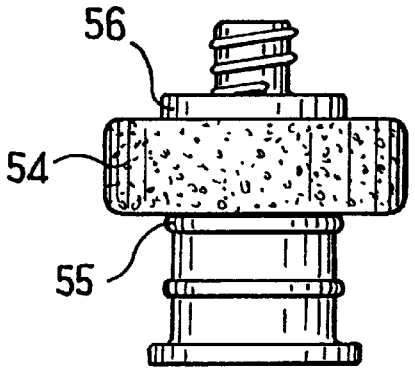
FIG. 12 shows a fifth embodiment of the invention.

In a variant, as shown in FIG. 12, it is possible to provide relief 55 and 56 on the body of the bottle with the anti-spill piece 54 being received therebetween, and being put into place on the bottle by elastic deformation. The bottle may have a series of portions in relief enabling the user to position the anti-spill piece at various distances from the opening of the bottle, depending on how full it is, for example.

The anti-spill piece 54 is held against the body of the bottle sufficiently tightly to prevent it from rotating relative thereto, thereby enabling the user to unscrew the applicator by holding the anti-spill piece only.

Figure 13:
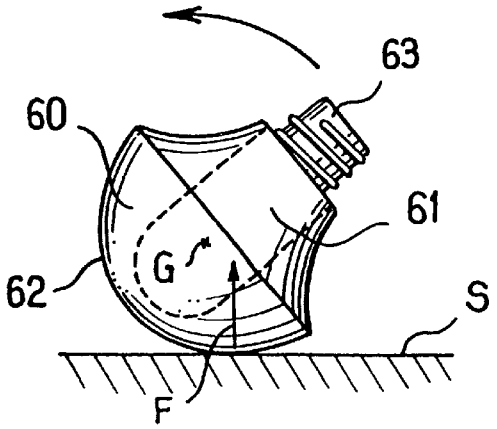
FIG. 13 shows a sixth embodiment of the invention.

In the embodiment of FIG. 13, the anti-spill piece 60 completely surrounds the bottle 61, being stuck thereto, for example.

This anti-spill piece 60 has a substantially hemispherical, outwardly convex bottom outside surface 62 shaped to roll on a plane surface S.

The reaction force F exerted by the surface S on the anti-spill piece 61 is located relative to the center of gravity G of the receptacle in such a manner as to exert a couple thereon which tends to return it to a position in which its axis slopes upwards sufficiently for the level of liquid in the bottle 61 to remain below the edge of the neck 63.

More precisely, the reaction force F is situated relative to the vertical plane containing the center of gravity G on the same side as the neck 63.

When in general terms the anti-spill piece covers all of the bottle or a major portion thereof, it is advantageous to make the anti-spill piece out of transparent material or to provide it with openings that enable the user to see the level of liquid in the bottle. This also makes it easier for the user to take substance out of the bottle when it is nearly empty.

Figure 14:
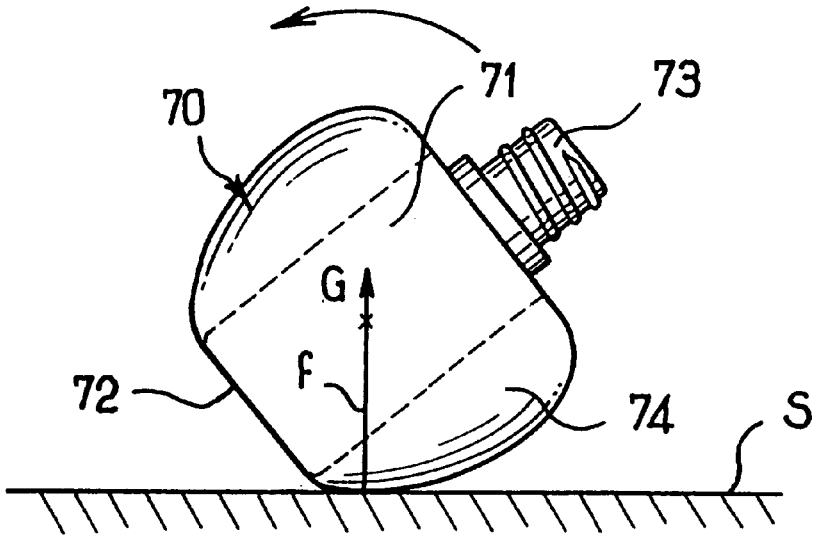
FIGS. 14 and 15 show a seventh embodiment of the invention.
Figure 15:
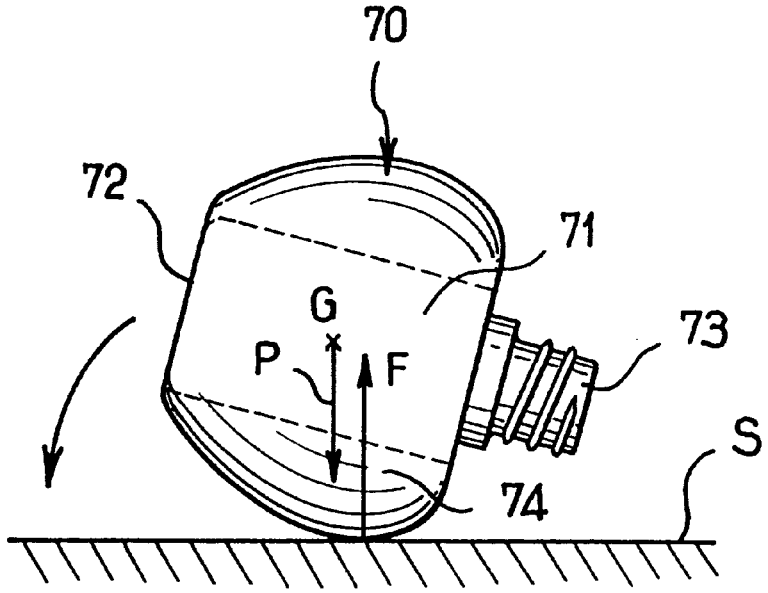

FIGS. 14 and 15 show a receptacle 70 constituting another embodiment of the invention.

The receptacle 70 comprises a bottle 71 whose body is circularly cylindrical, the bottle being fitted at one end with a flat bottom 72 and at its other end with a threaded neck 73.

The anti-spill piece 74 is annular in shape and has an outside surface that is outwardly convex.

Its inside surface is circularly cylindrical so as to match the shape of the bottle 71.

The anti-spill piece 74 is held on the bottle 71 by friction, for example, being held sufficiently tightly to enable the user to screw and unscrew the applicator on the bottle without difficulty while holding the anti-spill piece.

In axial section, the outside surface of the anti-spill piece 74 is shaped so that the reaction force F is positioned relative to the center of gravity of the receptacle in such a manner as to create a couple that tends to return the receptacle to an equilibrium position as shown in FIG. 14, where the axis of the receptacle is inclined upwards sufficiently to ensure that the liquid level inside the bottle 71 is below the edge of the neck 73.

When the receptacle is overturned, its weight P exerts a couple tending to return it to the above-specified equilibrium position, as shown in FIG. 15.

Figure 16:
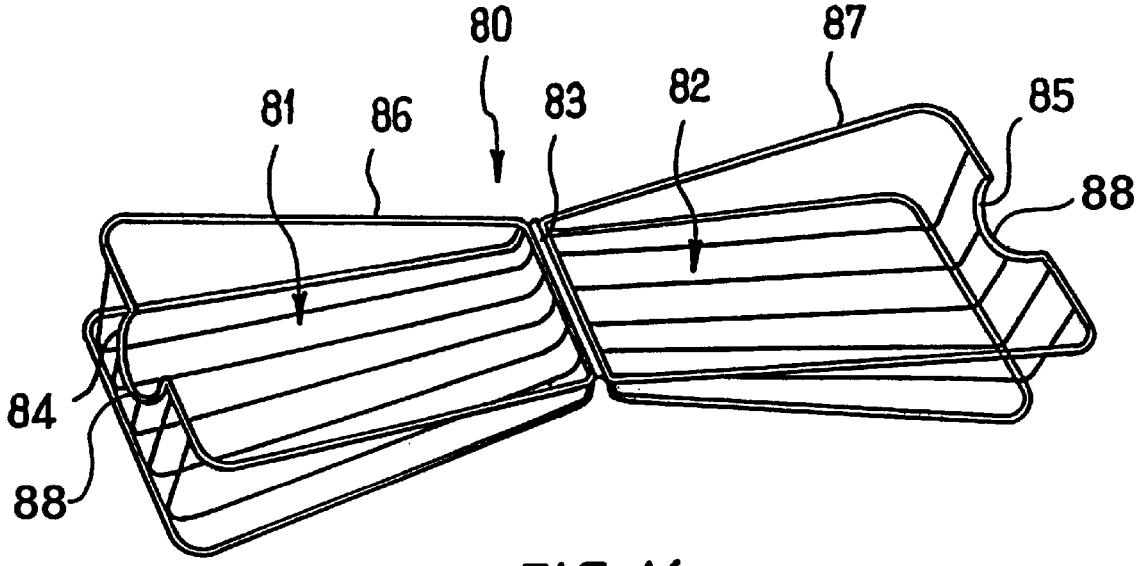
FIGS. 16 and 17 show an eighth embodiment of the invention.

FIG. 16 shows an anti-spill piece 80 constituting an eighth embodiment of the invention.

This anti-spill piece 80 comprises two portions 81 and 82 for assembling around the bottle, e.g. the bottle 7 as described above.

The portions 81 and 82 are connected together at one end by a hinge 83 and each of them has a coupling 84 or 85 at its end remote from the hinge 83.

Figure 17:
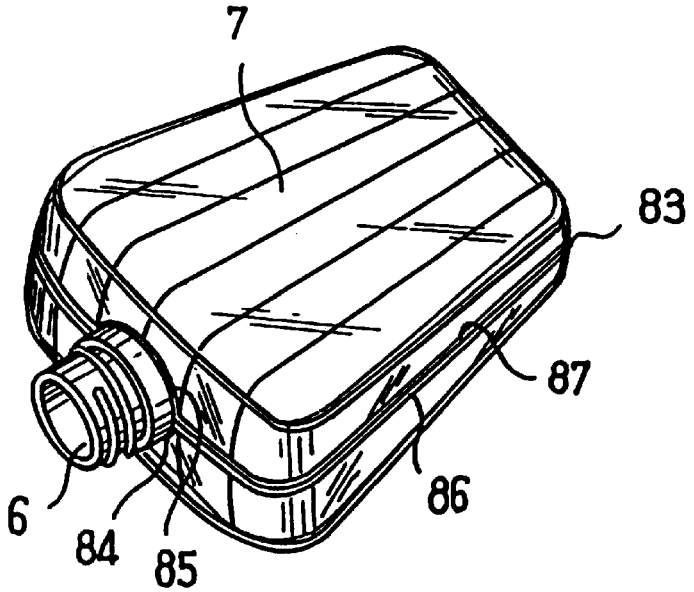

The couplings 84 and 85 are designed to form a collar around the neck 6 of the bottle 7 when the portions 81 and 82 are assembled against each other, as shown in FIG. 17.

The couplings 84 and 85 are connected to the hinge 83 via respective sets of bars referenced 86 for the portion 81 and 87 for the portion 82.

When the portions 81 and 82 are closed around the bottle 7, the bars 86 and 87 of the anti-spill piece 80 constitute a cage protecting the bottle 7 from shock and holding the opening of the neck 6 above the level of the liquid in the bottle 7, when filled to a given level. The cage can be made of elastically deformable material.

The anti-spill piece 80 can be made of metal or of plastics material.

A web or rim of elastomer material 88 can be provided level with the couplings 84 and 85 so as to enable them to fit around necks of different diameters.

The bars 86 and 87 are curved so as to maintain the axis of the bottle 7 inclined upwards to a sufficient extent to prevent liquid spilling out through the neck 6 when the anti-spill piece 80 is resting on a plane surface.

The portions 81 and 82 can be assembled together by any means, for example by providing them in the vicinity of the couplings 84 and 85 with complementary fastening means (not shown).

Naturally, the invention is not limited to the embodiments described above.

The receptacle may optionally include a wiper member for wiping the applicator.

By using an anti-spill piece of the invention, a receptacle containing nail polish, for example, can be used without worry while travelling, e.g. standing on a relatively unstable surface such as a fold-down tray mounted on a seat.

What is claimed is:

1. A receptacle, comprising:

an applicator;

a body forming a reservoir suitable to contain a fluid, the body having a neck and a top opening;

at least one anti-spill device, each anti-spill device having a first portion and a second portion assembled about the body to form a cage, the cage being suitable to hold the top opening of the receptacle above a level of the fluid substance contained in the body when the receptacle is resting on a plane surface, wherein a shape and material of the cage are chosen to protect the body from shock; and wherein the first and second portions each comprise a coupling, the coupling of the first portion and the coupling of the second portion forming a collar around the neck of the body when the first and second portions are connected together.

2. A receptacle, comprising:

an applicator;

a body forming a reservoir suitable to contain a fluid, the body having a neck and a top opening; and at least one anti-spill device, each anti-spill device having a first portion and a second portion assembled about the body to form a cage, said first portion being moveable with respect to the second portion and assembled to the second portion, the cage being suitable to hold the top opening of the receptacle above a level of the fluid substance contained in the body when the receptacle is resting on a plane surface, wherein a shape and material of the cage are chosen to protect the body from shock.

3. The receptacle according to claim 1, wherein the coupling of the first portion and the coupling of the second portion comprise one of either a web and a rim of elastomer material to permit the couplings to fit around necks having different diameters.

4. The receptacle according to claim 1, wherein the first and second portions are connected together by a hinge.

5. The receptacle according to claim 3, wherein the first and second portions each further comprise a curved bar, the coupling of the first portion and the coupling of the second portion being connected to the hinge by the curved bars.

6. The receptacle according to claim 1, wherein the at least one anti-spill device is made of an elastically deformable material.

7. The receptacle according to claim 1, wherein the at least one anti-spill device is fixed on the body such that the at least one anti-spill piece cannot rotate relative to the body.

8. The receptacle according to claim 1, wherein the neck is threaded and the applicator is screwed onto the neck.

9. The receptacle according to claim 1, wherein the receptacle has a capacity less than or equal to 100 milliliters.

10. The receptacle according to claim 1, wherein the at least one anti-spill device is designed to be fixed to the body of the receptacle.

11. The receptacle according to claim 2, wherein the coupling of the first portion and the coupling of the second portion comprise one of either a web and a rim of elastomer material to permit the couplings to fit around necks having different diameters.

12. The receptacle according to claim 2, wherein the first and second portions are connected together by a hinge.

13. The receptacle according to claim 2, wherein the first and second portions each further comprise a curved bar, the coupling of the first portion and the coupling of the second portion being connected to the hinge by the curved bars.

14. The receptacle according to claim 2, wherein the at least one anti-spill device is made of an elastically deformable material.

15. The receptacle according to claim 2, wherein the at least one anti-spill device is fixed on the body such that the at least one anti-spill device cannot rotate relative to the body.

16. The receptacle according to claim 2, wherein the neck is threaded and the applicator is screwed onto the neck.

17. The receptacle according to claim 2, wherein the receptacle has a capacity less than or equal to 100 milliliters.

18. The receptacle according to claim 2, wherein the receptacle comprises means to prevent the reservoir from being withdrawn from the cage when said first and second portions are assembled.

19. The receptacle according to claim 18, wherein the cage has a cross section adapted to prevent the reservoir from being withdrawn.

20. The receptacle according to claim 10, wherein the cage comprises walls that are spaced from the reservoir.

* * * * *